US005760709A

United States Patent [19]

Hayashi

[11] Patent Number: 5,760,709

[45] Date of Patent: Jun. 2, 1998

[54] ROAD/VEHICLE COMMUNICATION METHOD AND DEVICE

[75] Inventor: Hironao Hayashi, Gifu-ken, Japan

[73] Assignee: Toyota Jidosha Kabushiki Kaisha, Toyota, Japan

[21] Appl. No.: 622,150

[22] Filed: Mar. 27, 1996

[30] Foreign Application Priority Data

Apr. 28, 1995 [JP] Japan ..... 7-106754

[51] Int. Cl.[6] ..... G08G 1/00

[52] U.S. Cl. ..... 340/928; 340/933; 455/115; 455/67.1; 455/67.7

[58] Field of Search ..... 340/928, 933, 340/531, 532, 937, 825.15, 825.16, 825.54, 825.55, 50.5, 988; 455/115, 67.7, 67.1

[56] References Cited

U.S. PATENT DOCUMENTS

| | | | |
|---|---|---|---|
| 5,345,595 | 9/1994 | Johnson et al. | 455/33.1 |
| 5,465,321 | 11/1995 | Smyth | 395/22 |
| 5,554,984 | 9/1996 | Shigenaga et al. | 340/437 |

FOREIGN PATENT DOCUMENTS 6-243316 9/1994 Japan .

*Primary Examiner*—Jeffery Hofsass
*Assistant Examiner*—Benjamin C. Lee
*Attorney, Agent, or Firm*—Cushman Darby & Cushman IP Group of Pillsbury Madison & Sutro LLP

[57] ABSTRACT

A road/vehicle communication method for communication between a plurality of road devices, which are provided with a plurality of road antenna devices at respective gates, and a vehicle communication device, which is mounted to a vehicle and transmits and receives information to and from the plurality of road devices by radio waves, includes the steps of: when the vehicle passes through a first gate, the vehicle communication device receiving gate information which relates to the first gate and which is transmitted from a road antenna device of the first gate, and the vehicle communication device transmitting the received gate information at a second gate; the second gate receiving gate information from a plurality of vehicle communication devices, and computing a communication probability for each antenna device of the first gate when a number of received gate information corresponding to the first gate has reached a predetermined number; and comparing, for each road antenna device, the communication probability with a predetermined reference value, and detecting, as a malfunctioning road antenna device, a road antenna device for which a difference between the communication probability and the predetermined reference value exceeds a predetermined value. Accordingly, at the second gate, a malfunctioning road antenna device can be detected among the road antenna devices of the first gate, and measures can be taken with respect to the malfunctioning road antenna device.

17 Claims, 14 Drawing Sheets

ENTRANCE GATE
100
ROUTE POINT
200
EXIT GATE
300
132
117
ENTRANCE ANTENNA
232
217
ROUTE ASCERTAINING ANTENNA
331
317
ADVANCE NOTICE ANTENNA
332
341
TOLL STATION ANTENNA
390
380
LOCAL CONTROLLER
360
VEHICLE TYPE DETECTING SYSTEM
350
UNAUTHORIZED PASSING VEHICLE PHOTOGRAPHING SYSTEM
323
TOLL MANUAL PAYMENT SYSTEM
352
(354,356)
324
(326
328)
90
30
62
123

MALFUNCTIONING ANTENNA DETECTING DEVICE

ROAD/VEHICLE COMMUNICATION METHOD AND DEVICE

FIELD OF THE INVENTION

The present invention relates to a road/vehicle communication method and device, and in particular, to a road/vehicle communication method and device which can transmit and receive information by radio communication between a vehicle communication device which is installed in a vehicle and a road device which is provided on a roadside.

DESCRIPTION OF THE RELATED ART

Fee-charging facilities utilize some type of method for receipt of fees for use of the facility. For example, a vehicle traveling on a toll road must pay a fee which corresponds to the type of vehicle and to the distance the vehicle has traveled on the toll road. A road/vehicle communication method for automatically collecting tolls at the entrance gate or the exit gate of a toll road is known as a method of automatically collecting fees for use of a fee-charging facility. In the road/vehicle communication method, a communication device (hereinafter, "road device") is provided on a roadside. The road device serves as an interrogator which asks the vehicle for information, and has a road antenna having a set communication area for transmitting and receiving (communicating) radio waves. Further, a communication device (hereinafter, "vehicle device") is provided at a vehicle. The vehicle device has an antenna, and serves as a responder for responding, within the communication area, with regard to the information which was inquired about by the road device. In this way, in the road/vehicle communication method, information is transmitted and received by radio communication between the vehicle device and the road device.

As is well known, an antenna for communicating via radio waves has a communication area. Reliable information must be transmitted and received between the vehicles traveling through the respective lanes in a toll gate and the respective road devices corresponding thereto. Therefore, information is transmitted and received between the vehicle devices and the road devices with a one-to-one correspondence being provided between the vehicle devices and the road devices.

In order to minimize the receipt in a given communication area of radio waves from vehicles traveling in adjacent lanes, it is necessary to reduce the radio wave intensity of the communication radio waves or to reduce the size of the communication area for each lane.

However, if the radio wave intensity is reduced or the communication area is made smaller, communication is carried out by radio waves having a weak radio wave intensity in a limited communication area. Therefore, the information may be deficient due to the insufficient radio wave intensity, and the reliability of the transmitting and receiving of information deteriorates. Further, in cases in which the antenna is malfunctioning, there is unsatisfactory communication, and the reliability of the transmission and receipt of information deteriorates.

In order to solve the above drawbacks, Japanese Patent Application Laid-Open No. 6-243316 discloses radio communication between vehicle devices and road devices at a multi-lane gate with the communication areas of the respective antennas being set to overlap one another. In accordance with this technology, a plurality of road antennas are assigned to a single vehicle device so as to enable reliable communication.

In conventional road/vehicle communication devices, a plurality of road antennas are assigned to a single vehicle device. However, when the vehicle device detects that a road antenna is malfunctioning, the vehicle device cannot specify which of the road antennas is the road antenna which is malfunctioning.

SUMMARY OF THE INVENTION

In view of the aforementioned, an object of the present invention is to provide a road/vehicle communication method and device in which information can be reliably transmitted and received between a vehicle communication device and a road device by detecting a malfunctioning road antenna.

A first aspect of the present invention is a road/vehicle communication method for communication between a plurality of road devices, which are provided with a plurality of road antenna devices at respective gates, and a vehicle communication device, which is mounted to a vehicle and transmits and receives information to and from the plurality of road devices by radio waves, comprising the steps of: (a) when the vehicle passes through a first gate, the vehicle communication device receiving gate information which relates to the first gate and which is transmitted from a road antenna device of the first gate, and the vehicle communication device transmitting the received gate information at a second gate; (b) the second gate receiving gate information from a plurality of vehicle communication devices, and computing a communication probability for each antenna device of the first gate when a number of received gate information corresponding to the first gate has reached a predetermined number; and (c) comparing, for each road antenna device, the communication probability with a predetermined reference value, and detecting, as a malfunctioning road antenna device, a road antenna device for which a difference between the communication probability and the predetermined reference value exceeds a predetermined value.

A second aspect of the present invention is a road/vehicle communication device for communication between a plurality of road devices, which are provided with a plurality of road antenna devices at respective gates, and a vehicle communication device, which is mounted to a vehicle and transmits and receives information to and from the plurality of road devices by radio waves, wherein the vehicle communication device includes: storing means for storing gate information which is received when the vehicle passes through a first gate and which is transmitted from a road antenna device of the first gate and which relates to the first gate; and transmitting means for transmitting stored gate information at a second gate, and the road device includes: roadside receiving means for receiving, at the second gate, gate information from a plurality of vehicle communication devices; communication probability computing means for computing a communication probability for each road antenna device of the first gate when a number of received gate information corresponding to the first gate has reached a predetermined number; comparing means for comparing, for each road antenna device, the communication probability with a predetermined reference value; and detecting means for detecting, as a malfunctioning road antenna device, a road antenna device for which a difference between the communication probability and the predetermined reference value exceeds a predetermined value.

In accordance with the road/vehicle communication method of the first aspect, when the vehicle passes through a first gate such as an entrance gate or a route point or the like, the vehicle communication device receives gate information which is transmitted from a road antenna device of the first gate and which relates to the first gate. The gate information may include information expressing the position of the entrance gate or the route point, or a predetermined gate number, or the year, month and date on which the vehicle passed through the gate or the point, or the like. The vehicle communication device transmits the received gate information to a second gate which is an exit toll station or the like. In this way, the second gate can receive all of the gate information received by vehicles passing through the first gate. The second gate receives gate information regarding the first gate from a plurality of vehicle communication devices. When the number of received gate information corresponding to the first gate reaches a predetermined number, a communication probability is computed for each of the road antenna devices at the first gate. More specifically, the gate information includes information expressing through which of the road antenna devices of the first gate the vehicle communication device communicated with the road device. Therefore, when the number of gate information received at the second gate reaches a predetermined number, the number of times the predetermined number of vehicles communicated with the respective road antenna devices of the first gate can be obtained. Further, when one vehicle passes through the first gate, there exist probabilities expressing the possibility of communication of the vehicle communication device of that vehicle with the respective road antennas of the first gate. Accordingly, when the number of gate information reaches the predetermined number, a communication probability, which expresses the possibility of communication at the time a predetermined number of vehicles have passed through the first gate, can be determined for each of the road antenna devices from the previously-mentioned probabilities and from the number of times of communication with the respective road antenna devices. When there is a road antenna device at the first gate which malfunctioned in this communication, the gate information from the malfunctioning road antenna device is inaccurate, and the determined communication probability differs from the communication probability which is the standard in a case in which the road device is not malfunctioning. The communication probability of a road antenna device which is functioning properly corresponds to the standard communication probability. Accordingly, even if there is a malfunctioning road antenna device at the first gate, the determined communication probability expresses the respective conditions of the road antenna device. In this way, the determined communication probability is compared with a predetermined reference value for each of the road antenna devices. A road antenna device, for which the difference between the determined communication probability and the reference value exceeds a predetermined value, can be detected as a malfunctioning road antenna device.

The above-described road/vehicle communication method can be realized by the road/vehicle communication device of the second aspect. The vehicle communication device is provided with a storing means for storing gate information which is received when the vehicle passes through the first gate and which is transmitted from a road antenna device of the first gate and which relates to the first gate. The stored gate information is transmitted at the second gate by the transmitting means. The road device is provided with a roadside receiving means at the second gate, which means receives gate information from a plurality of vehicle communication devices. The communication probability computing means computes the communication probability for each road antenna device of the first gate when the number of received gate information corresponding to the first gate reaches a predetermined number. For each of the road antenna devices, the comparing means compares the communication probability and a predetermined reference value. The detecting means detects a road antenna device, for which the difference between the determined communication probability and a predetermined reference value exceeds a predetermined value, as a malfunctioning road antenna device.

The road antenna device may include an antenna installed at the road and an antenna control device which controls the antenna.

In accordance with the above-described aspects of the present invention, gate information transmitted from road antennas at a first gate is transmitted from vehicle communication devices at a second gate. A road device computes a communication probability for each antenna of the first gate from the number of gate information. A road antenna device, for which the difference between the communication probability and a reference value exceeds a predetermined value, is detected as a malfunctioning antenna. Therefore, a superior effect can be achieved in that which of the road antennas is a malfunctioning antenna can be specified.

DESCRIPTION OF THE PREFERRED EMBODIMENTS

Hereinafter, a first embodiment of the present invention will be described in detail with reference to the drawings. In the first embodiment, the present invention is applied to an automatic toll collecting device which, by effecting radio communication between a vehicle device (to be described in detail later) which is provided at a vehicle and a road device which is installed in the ground at the entrance gate or the exit gate or the like of a toll road, determines the vehicle type and the transit sections (route) traveled by a vehicle, and automatically collects a toll without the vehicle stopping at the entrance gate or the exit gate.

Figure 1:
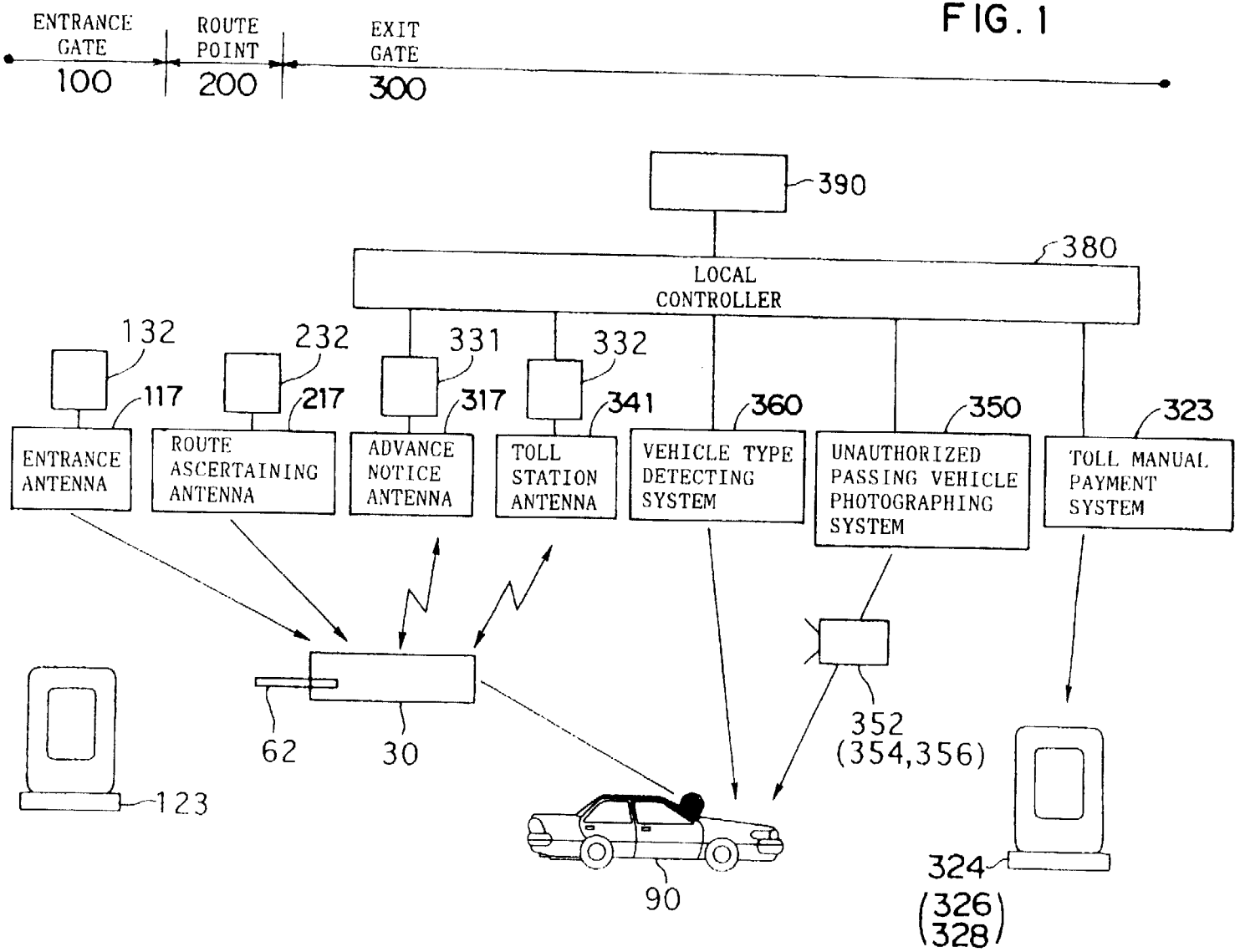
FIG. 1 is a block diagram illustrating an automatic fee collecting device to which the present invention may be applied

As illustrated in FIG. 1, a vehicle device 30 provided at a vehicle 90 is equipped with an IC card read/write device 60 (see FIG. 4) as will be described later. An IC card 62, on which information such as balance information expressing the remaining balance on the card or the like is stored, can be inserted into and removed from the IC card read/write device 60. The vehicle device 30 is equipped with a storage circuit which stores fixed data such as an ID code (e.g., the vehicle registration number), vehicle type information, and the like. By using the IC card read/write device 60, the vehicle device 30 reads the toll balance information of the IC card 62 inserted in the device 60, and writes toll balance information onto the IC card 62.

As will be described later, road devices, which serve as ground equipment and which transmit and receive various types of information to and from the vehicle device 30, are provided respectively at an entrance gate 100 of a toll road, a route point 200 such as immediately before or after a branching point of the route, a service area, and an exit gate 300.

A road device, which includes an entrance antenna 117 formed by a flat antenna and an entrance antenna control device 132 connected to the entrance antenna 117, is the entrance gate 100 of the toll road can be transmitted to the vehicle device 30 provided in the vehicle by the entrance antenna control device 132 via the entrance antenna 117, and signals from the vehicle device 30 can be received by the entrance antenna control device 132 via the entrance antenna 117. Further, a passage ticket issuing device 123, which issues passage tickets as in a conventional manner, is provided at the entrance gate 100 for vehicles which will pay tolls by manual payment due to their inability to pay tolls automatically.

A road device, which includes a route ascertaining antenna 217 formed by a flat antenna and a route ascertaining antenna control device 232 connected to the route ascertaining antenna 217, is provided at the route point 200. Information which expresses which route the vehicle took at a branch point or traveled route information which expresses what route the vehicle traveled on the toll road (e.g., information such as the installed position of the route ascertaining antenna control device) is transmitted to the vehicle device 30 by the route ascertaining antenna control device 232 via the route ascertaining antenna 217.

Two types of antennas, an advance notice antenna 317 and a toll station antenna 341 which are each formed by a flat antenna, are provided at the exit gate 300 in order to improve the reliability of the transmission and reception of information by radio waves. An advance notice antenna control device 331 is connected to the advance notice antenna 317, and a toll station antenna control device 332 is connected to the toll station antenna 341. The advance notice antenna control device 331 and the toll station antenna control device 332 are connected to a local controller 380. The advance notice antenna 317, the toll station antenna 341, the advance notice antenna control device 331, the toll station antenna control device 332, and the local controller 380 serve as the exit gate road device to which the present invention is applicable. However, the advance notice antenna 317 and the advance notice antenna control device 331 may be omitted.

A vehicle type detecting system 360, an unauthorized passing vehicle photographing system 350, and a toll manual payment system 323 are provided at the exit gate 300. The vehicle type detecting system 360 detects the type of the vehicle by image processing or the like. A camera 352, which photographs vehicles which pass through without authorization such as vehicles which pass through without paying the toll, is connected to the unauthorized passing vehicle photographing system 350. The toll manual payment system 323 is provided for vehicles which cannot pay tolls automatically. These respective systems are controlled collectively by the local controller 380 so as to provide measures for cases in which a toll cannot be paid or the like, and to automatically collect tolls corresponding to the transit sections (route) traveled by the vehicle and the type of the vehicle.

Figure 2:
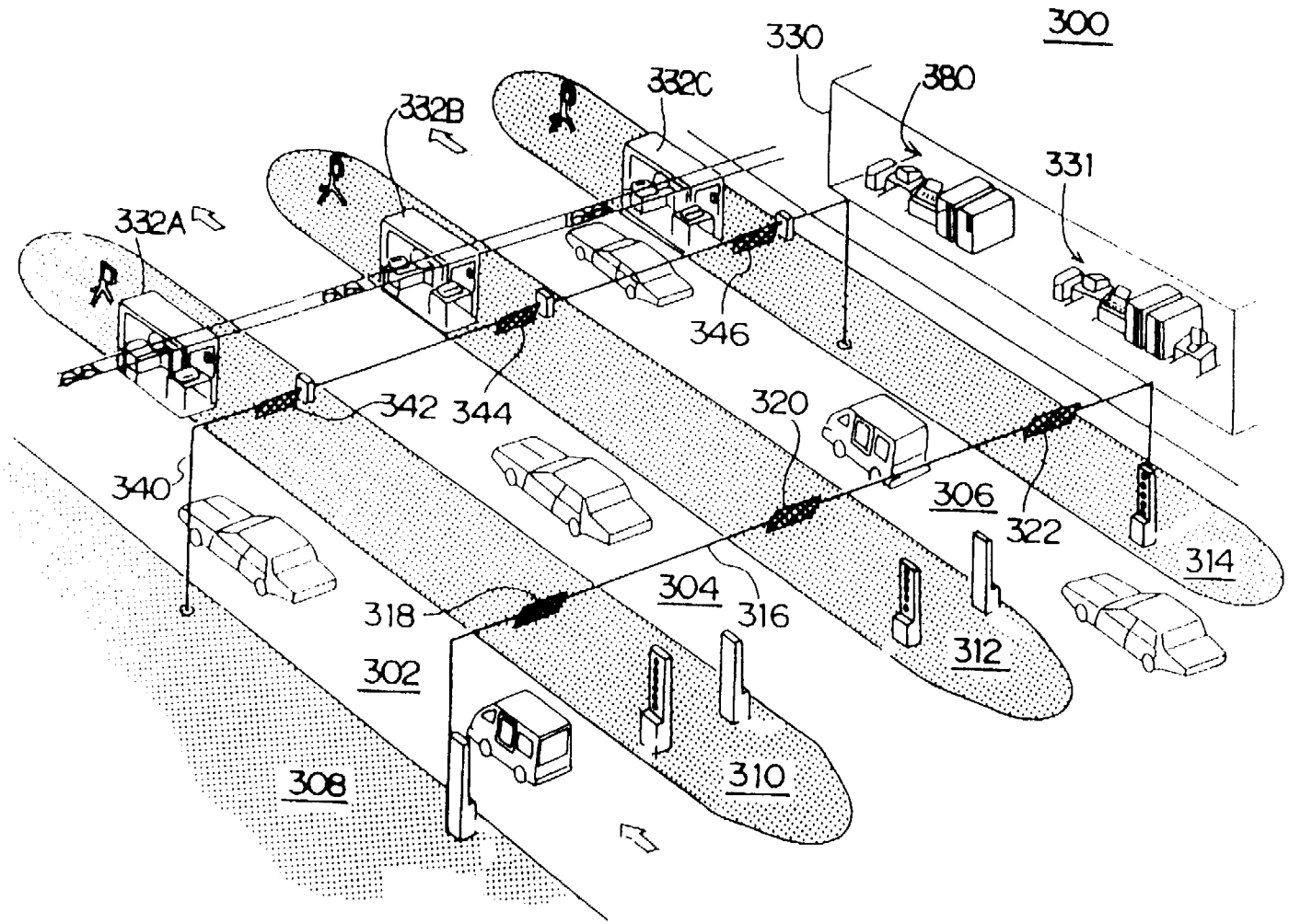
FIG. 2 is a schematic perspective view illustrating an exit gate of the automatic fee collecting device of FIG. 1.

Next, an example of the schematic structure of the exit gate 300 relating to the present embodiment will be described. As illustrated in FIG. 2, three lanes 302, 304, 306 are provided at the exit gate 300 of the toll road. The lane 302 is provided between a plot of ground 308 and a median strip 310. The lane 304 is formed between the median strip 310 and median strip 312, and the lane 306 is formed between the median strip 312 and a plot of ground 314.

An arch 316 is disposed from the plot of ground 308 to the plot of ground 314 so as to straddle over the plurality of lanes. Advance notice antennas 318, 320, 322 are mounted on the arch 316. The advance notice antenna 318 is positioned above the lane 302, and transmits to vehicles traveling in the lane 302 advance notice information informing the vehicles that toll payment and receipt is forthcoming. In the same way, the advance notice antenna 320 is positioned above the lane 304 and transmits information to vehicles traveling in the lane 304, whereas the advance notice antenna 322 is positioned above the lane 306 and transmits information to vehicles traveling in the lane 306.

An exit gate control center 330 is located at the plot of ground 314. The advance notice antenna control device 331 and the local controller 380 which will be discussed later are disposed in the exit gate control center 330. The advance notice antennas 318, 320, 322 are connected to the advance notice antenna control device 331.

An arch 340, which extends from the plot of ground 308 to the plot of ground 314 so as to straddle over the plurality of lanes, is provided at the downstream side, in the traveling direction of the vehicles, of the position at which the arch 316 is disposed. Toll station antennas 342, 344, 346 are mounted on the arch 340. The toll station antenna 342 is positioned above the lane 302 and transmits and receives information relating to the toll to and from vehicles traveling in the lane 302. The toll station antenna 344 is positioned above the lane 304 and transmits and receives information to and from vehicles traveling in the lane 304. Similarly, the toll station antenna 346 is positioned above the lane 306 and transmits and receives information to and from vehicles traveling in the lane 306. Toll station antenna control devices 332A, 332B, 332C are connected to the toll station antennas 342, 344, 346 respectively, and are connected to the local controller 380.

Figure 3:
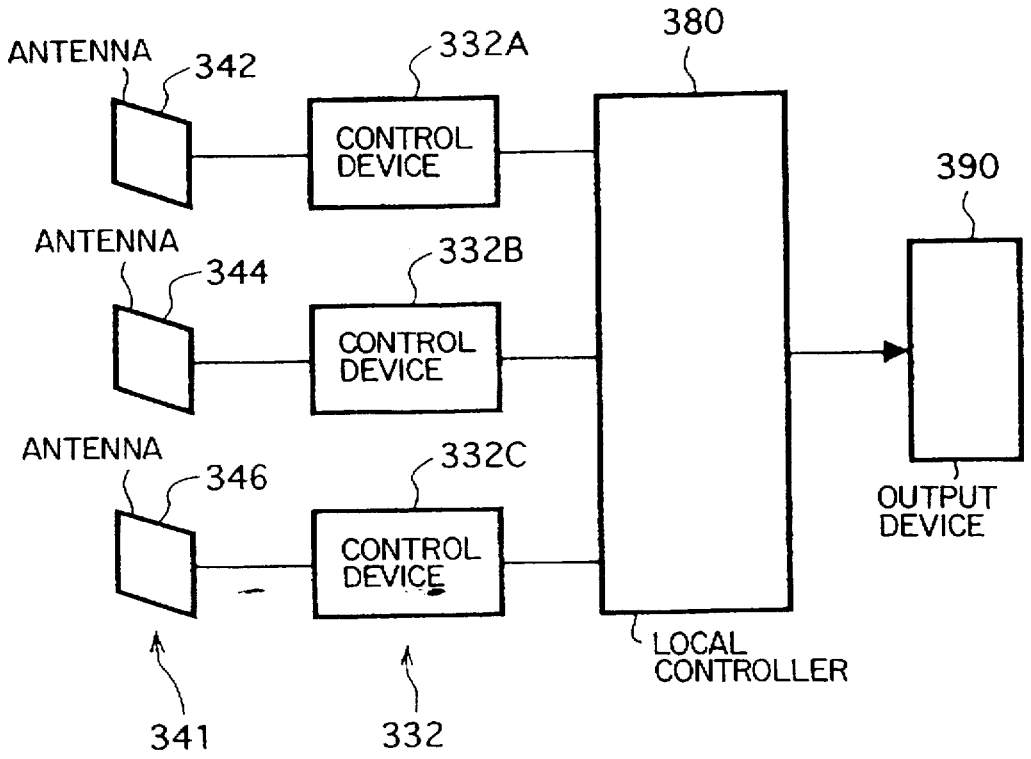
FIG. 3 is a block diagram illustrating a schematic structure of main portions for detecting a malfunctioning antenna at the exit gate.

As shown in FIG. 3, the toll station antennas 342, 344, 346 are connected to the local controller 380 via the respectively corresponding toll station antenna control devices 332A, 332B, 332C. The local controller 380 is connected to an output device 390 such as a printer device or a modem device for connection to a telephone line or the like. In the present embodiment, the toll station antennas, the toll station antenna control devices, and the local controller 380 function as a malfunctioning antenna detection device, as will be described in detail later.

The exit gate control center 330 of the exit gate 300 is connected to an unillustrated central computer. As will be explained later, a malfunctioning antenna may be detected at this central computer. Further, malfunctioning antennas may be detected for each of the toll station antenna control devices as will be described later.

Figure 4:
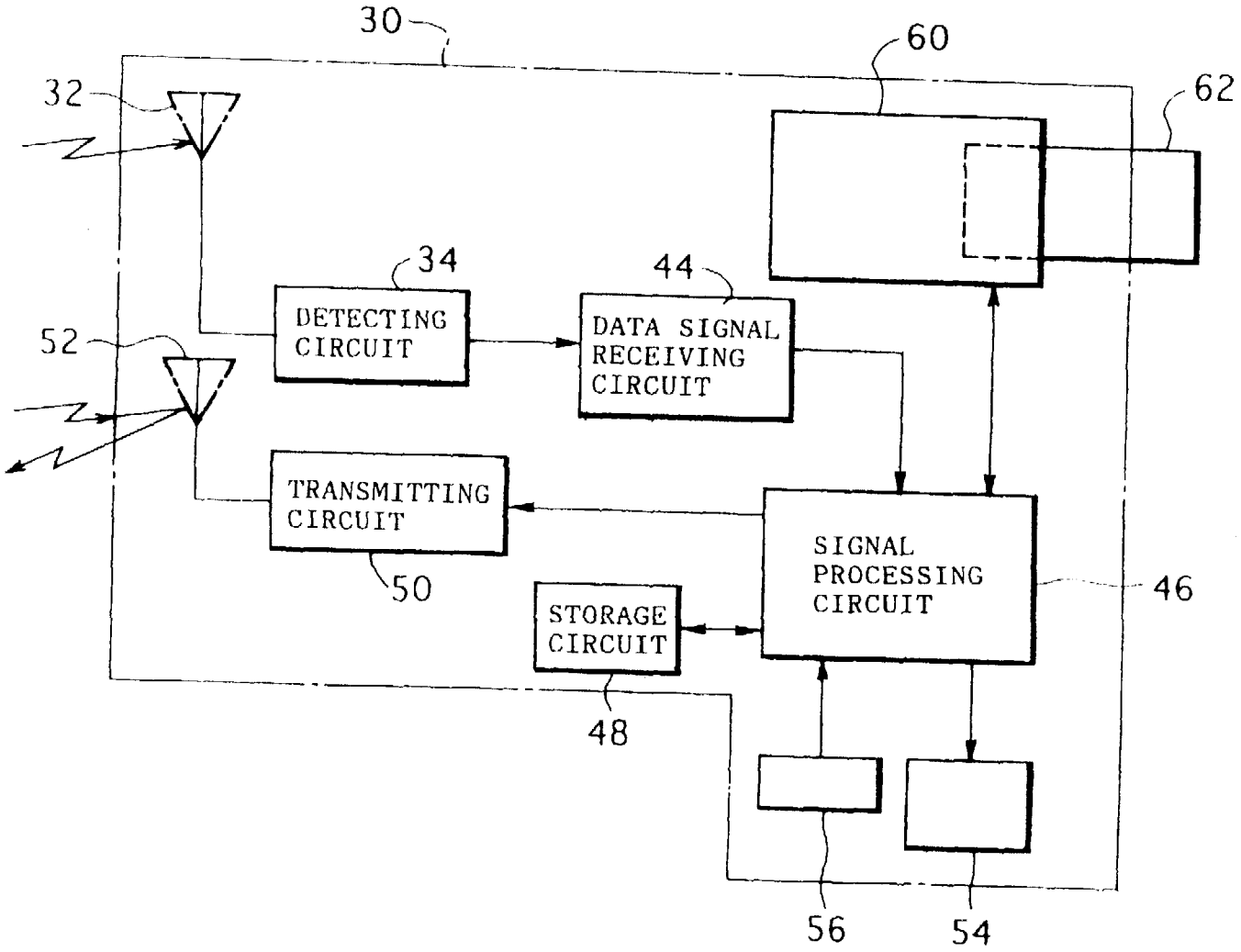
FIG. 4 is a block diagram illustrating a vehicle device of the present embodiment.

Next, the structure of the vehicle device 30 mounted to the vehicle will be described. As illustrated in FIG. 4, the vehicle device 30 includes a receiving antenna 32 which receives signals transmitted from a road device which will be described later. The receiving antenna 32 is connected to a detecting circuit 34 which detects modulated waves received by the receiving antenna 32 so as to obtain data signals. The detecting circuit 34 is connected via a data signal receiving circuit 44 to a signal processing circuit 46 which includes a microcomputer.

A storage circuit 48 and a transmitting circuit 50 are connected to the signal processing circuit 46. Route information, including the entrance gate number, the entrance antenna number, the gate numbers of the route points, and the antenna numbers at those gates, as well as data such as an ID code or vehicle type information or the like are stored in the storage circuit 48. The transmission circuit 50 transmits, as a response signal, a data signal or the like including the ID code. The transmission circuit 50 modulates an inquiry signal, which is an unmodulated carrier wave received by a transmitting/receiving antenna 52, by using a data signal from the signal processing circuit 46, and transmits the modulated signal via the transmitting/receiving antenna 52.

A display 54 and a ten key 56 are connected to the signal processing circuit 46. The display 54 is formed by an LCD or a CRT and displays the reachable range of the emitted signal or the like. The ten key 56 is used to input a signal such as a selection signal or the like to the signal processing circuit 46. Further, the IC card read/write device 60, in which the IC card 62 can be inserted and removed, is also connected to the signal processing circuit 46.

Electric power from the vehicle battery is constantly supplied to the vehicle device when the ignition is on.

Next, a description will be given of a road device which communicates with the vehicle device 30, by using a road device provided a t the exit gate 300 as an example. For simplicity of explanation, the following description will use the toll station antenna 342 and the toll station antenna control device 332A which are assigned to the transmission and receipt of radio waves for vehicles traveling in the lane 302.

Figure 5:
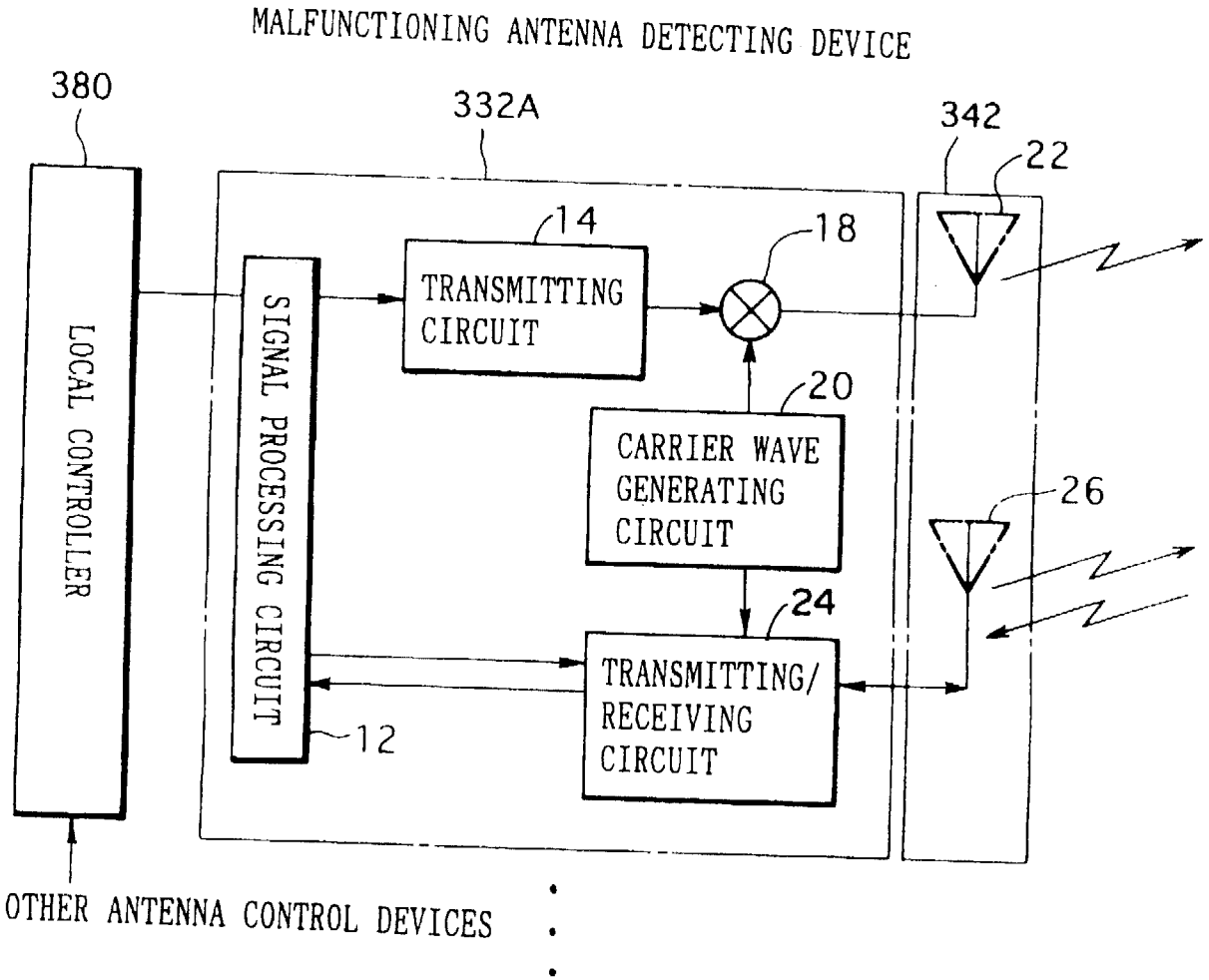
FIG. 5 is a block diagram illustrating an example of a road device.

As illustrated in FIGS. 5, the toll station antenna 342 assigned to the vehicles traveling in the lane 302 is formed by a transmitting antenna 22 and a transmitting/receiving antenna 26. The toll station antenna control device 332A is provided with a signal processing circuit 12 which includes a microcomputer. The signal processing circuit 12 is connected to a transmitting circuit 14 which transmits data signals (communication request signals) including commands. The transmitting circuit 14 is connected to the transmitting antenna 22 via a mixer 18. A carrier wave generating circuit 20, which generates carrier waves of a predetermined frequency, is connected to the mixer 18. The mixer 18 mixes a signal inputted from the transmitting circuit 14 and the carrier wave inputted from the carrier wave generating circuit 20, so as to modulate the carrier wave inputted from the carrier wave generating circuit 20 by the signal inputted from the transmitting circuit 14. The modulated wave is transmitted from the transmitting antenna 22 as a radio wave.

A transmitting/receiving circuit 24, which fetches the data signal from the modulated wave which was modulated and transmitted from the vehicle device 30 illustrated in FIG. 4 and received by the transmitting/receiving antenna 26, is connected to the carrier wave generating circuit 20. The transmitting/receiving circuit 24 is also connected to the signal processing circuit 12.

Because the structure of the other antennas at the exit gate 300 is the same as the above-described structure, description thereof will be omitted. Further, the structures of the antennas and antenna control devices at the entrance gate 100 and the route points 200 are the same as the above-described structure, and therefore, description thereof will be omitted.

Next, processing of the present embodiment will be described. First, a summary of transmission/receipt (communication) of basic signals of a handshake which takes place between the vehicle device and the road device will be described with reference to FIGS. 6 through 8B, by successive explanations of examples of the entrance gate 100, the route point 200, and the exit gate 300.

In the following description, when there is unsatisfactory communication which is caused by the vehicle device when the vehicle device and the road device are communicating, the vehicle device cannot store entrance information and route information which will be described later. Therefore, it is judged that the vehicle device is malfunctioning, and communication is initialized (i.e., set to be implemented from the first process).

Figure 6:
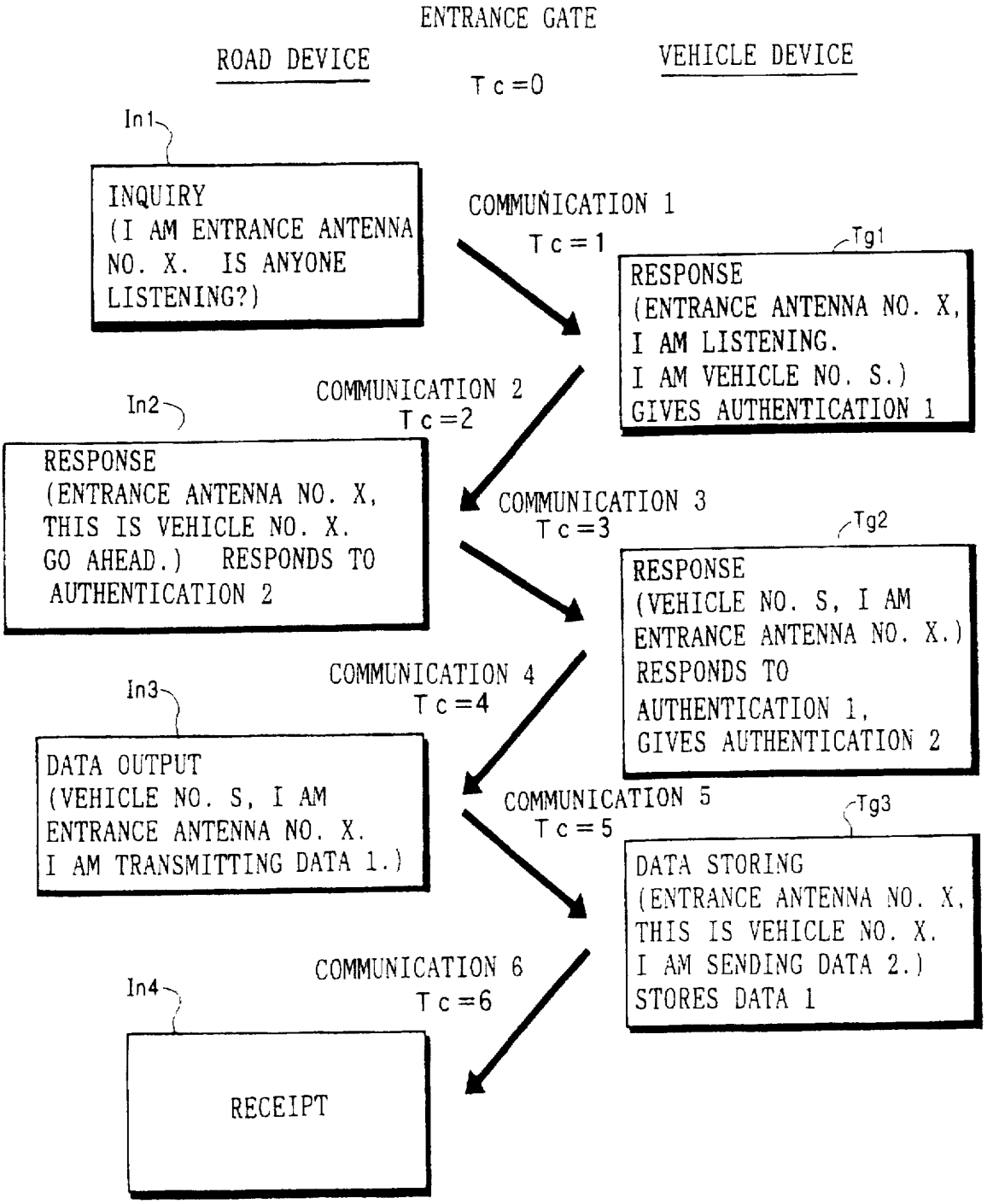
FIG. 6 is a process explanation diagram which summarily illustrates transmission and receipt (communication) of basic signals of a handshake which takes place between the vehicle device and the road device at an entrance gate.

As illustrated in FIG. 6, at the entrance gate 100, an inquiry signal which is a continuous wave is transmitted from the road device (communication 1 transmitting process contents In1) until a response signal from a vehicle device is received.

When a vehicle device receives the inquiry signal, the vehicle device generates a response signal 1 which gives an authentication 1 serving as identification information for mutual recognition between the vehicle device and the road device for carrying out a handshake. Thereafter, the vehicle device transmits the response signal 1 (communication 2 transmitting process contents Tg1). The transmission of the response signal 1 can be carried out by transmitting as the response signal a modulated wave which is the carrier wave (the received inquiry signal) which has been modulated by an ID code (an identification code specifying the vehicle).

When the road device receives the response signal 1 from the vehicle device, the road device generates a response signal including a response to the authentication 1 transmitted from the vehicle device and evidence of the road device which is carrying out the handshake, e.g., an authentication 2 which is formed by the antenna number. Thereafter, the road device transmits the response signal (communication 3 transmitting process contents In2).

When the vehicle device receives the response signal (communication 3), the vehicle device judges whether the authentication 2 included in this response signal matches the transmitted authentication 1. When the authentication 2 matches, the vehicle device generates a response signal 2 to the authentication 2 transmitted from the road device, and transmits this response signal (communication 4 transmitting process contents Tg2). When the vehicle device does not receive a response signal (communication 3), the vehicle device repeats (retries) transmitting the response signal 1 a predetermined number of times (three times in the present embodiment) after a predetermined time has passed or after a predetermined time has passed without receiving a response signal. When no response signal is received although transmission has been retried the predetermined number of times, the above-described processing is executed from the beginning. Further, in a case in which the authentications 1 do not match and the judgment is negative, the above-described processing is implemented in order to repeat (retry) transmission a predetermined number of times.

When the road device receives a response signal from the vehicle device, the road device judges whether the authentication 2 included in the response signal matches the transmitted authentication 2. When the authentications 2 match, it is judged that the vehicle device and the road device recognize each other. At this point, the handshake is realized, and data 1 relating to the entrance gate is transmitted (communication 5 transmitting process contents In3).

The data 1 transmitted by the road device of the entrance gate includes gate information expressing that the gate is an entrance gate, a gate number for identifying the entrance gate, an antenna number for identifying the transmitting antenna, and the year, month, date, hour and minute.

Incidentally, in the same way as the above-described processing executed at the vehicle device, signal receipt processing at the road device may be repeated if transmission of the signal after a predetermined period of time has elapsed has been retried a predetermined number of times (e.g., three times). In this way, at the road device as well, the road device waits for a predetermined signal, and processing is not intermittent.

At the vehicle device, the data 1 is received, and the received data 1 is stored as entrance information. The vehicle device transmits data 2 relating to the vehicle device (communication 6 transmitting process contents Tg3).

The data 2 transmitted from the vehicle device includes an OK flag which expresses whether receipt of data 1 has been completed properly (for example, a flag which is set when receipt is OK, i.e., has been completed properly, and which is reset when receipt is NG, i.e., no good). Further, data 2 may include vehicle information expressing the vehicle registration number, the vehicle type, the number of axles, and the like. When transmission of data 2 has been completed, the handshake is dissolved.

When the data 2 is received by the road device (process contents In4), receipt is completed and the handshake is dissolved. Thereafter, the processes are executed again from process contents In1.

There are cases in which the road device transmits data 1 but data 2 is not transmitted from the vehicle device. Therefore, in the same way as the above-described processing executed at the vehicle device, transmission of the data 2 after a predetermined period of time has elapsed may be retried a predetermined number of times.

Figure 7:
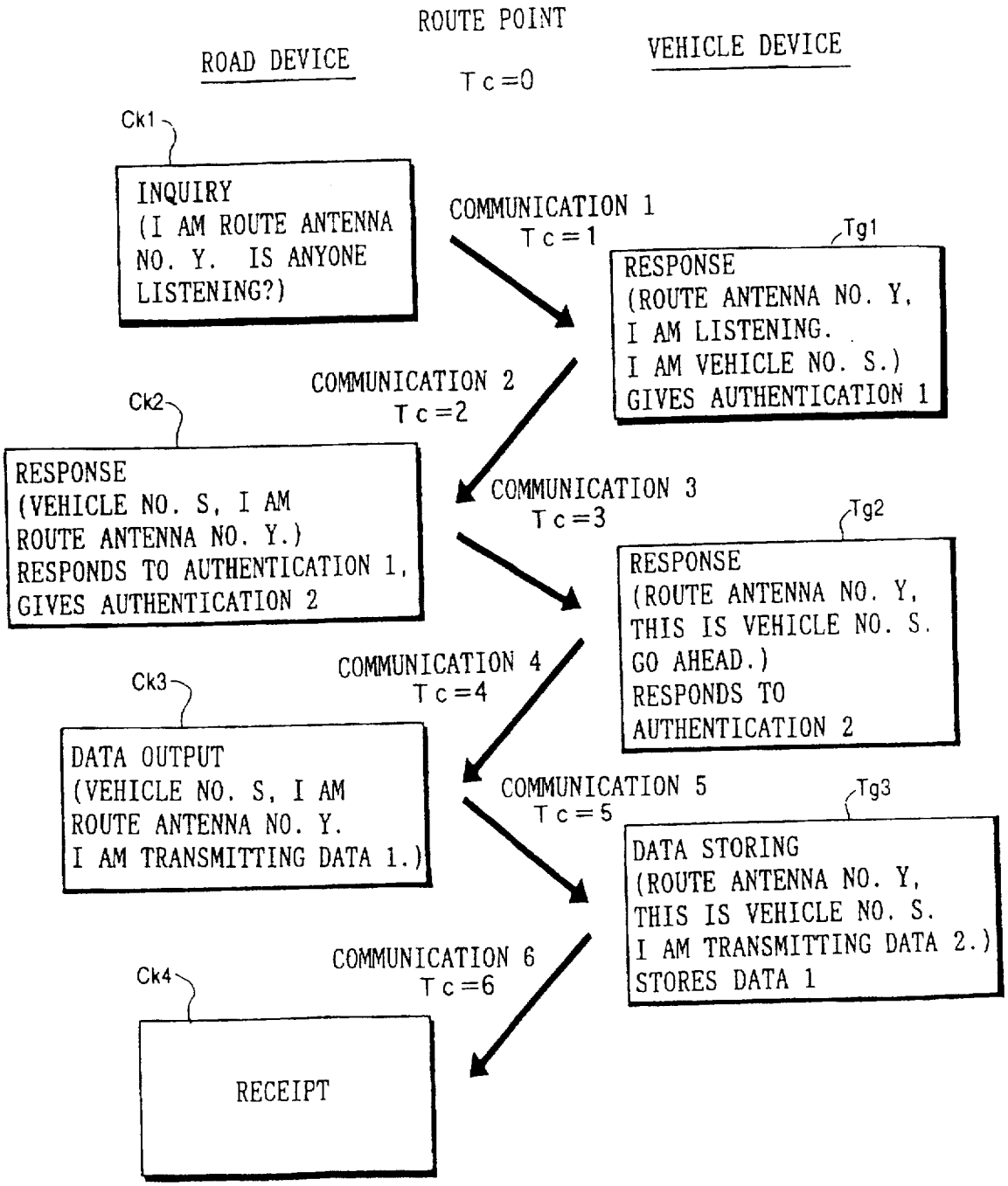
FIG. 7 is a process explanation diagram which summarily illustrates transmission and receipt (communication) of basic signals of a handshake which takes place between the vehicle device and the road device at a route point.

Next, communication at a route point will be explained with reference to FIG. 7. Communication at the route point is substantially similar to the communication at the entrance gate described in FIG. 6, and therefore, detailed description of the same portions will be omitted. As illustrated in FIG. 7, an inquiry signal formed by a continuous wave is transmitted from the road device (communication 1 transmitting process contents Ck1) until the road device receives a response signal from a vehicle device.

When the vehicle device receives the inquiry signal, the vehicle device generates a response signal 1, which gives an authentication 1 serving as identification information. Thereafter, the vehicle device transmits the response signal 1 (communication 2 transmitting process contents Tg1).

When the road device receives the response signal 1 from the vehicle device, the road device generates a response signal including a response to the authentication 1 transmitted from the vehicle device and evidence of the road device which is carrying out the handshake, e.g., an authentication 2 formed by the antenna number. Thereafter, the road device transmits the response signal 1 (communication 3 transmitting process contents Ck2).

The vehicle device receives the response signal. When the authentication 1 included in the response signal matches, the vehicle device generates a response signal 2 to the authentication 2 transmitted from the road device, and transmits the response signal 2 (communication 4 transmitting process contents Tg2).

The road device receives the response signal from the vehicle device. When the authentication 2 included in the response signal matches, it is judged that the vehicle device and the road device recognize each other. At this point, the handshake is established, and data 1 relating to the route point is transmitted (communication 5 transmitting process contents Ck3).

The data 1 transmitted by the road device at the route point includes gate information expressing that the road device is at a route point, a gate number (route number or the like) for identifying the route point, an antenna number for identifying the transmitting antenna, the lane number, and the year, month, date, hour and minute.

The vehicle device receives the data 1 and stores it as route information. Further, the vehicle device transmits data 2 relating to the vehicle device (communication 6 transmitting process contents Tg3).

The data 2 transmitted from the vehicle device at the route point includes an OK flag which expresses whether receipt of the data 1 this time has been completed properly (for example, a flag which is set when receipt is OK, i.e., has been completed properly, and which is reset when receipt is NG, i.e., not good), entrance information received at the entrance gate, contents of data 1 received at other route points, and the like.

When data 2 is received by the road device (process contents Ck4), receipt is completed and the handshake is dissolved. Thereafter, processing is executed again from the process contents Ck1.

Next, communication at the exit gate 300 will be explained with reference to FIGS. 8A and 8B. As communication at the exit gate is substantially similar to the above-described communication at the entrance gate and the route point, detailed description of the same portions will be omitted.

Figure 8A:
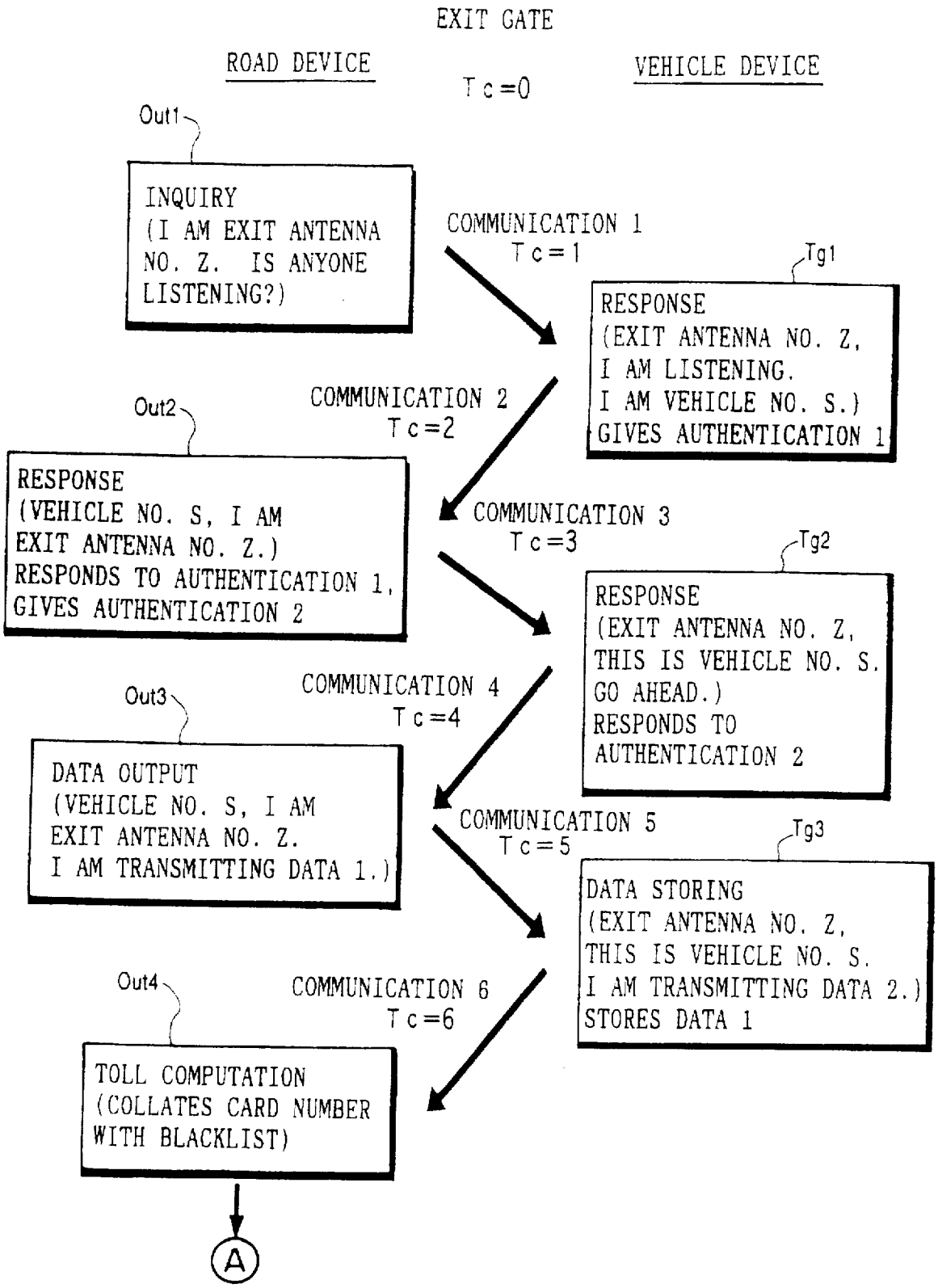
FIG. 8A is a process explanation diagram which summarily illustrates transmission and receipt (communication) of basic signals of a handshake which takes place between the vehicle device and the road device at the exit gate.
Figure 8B:
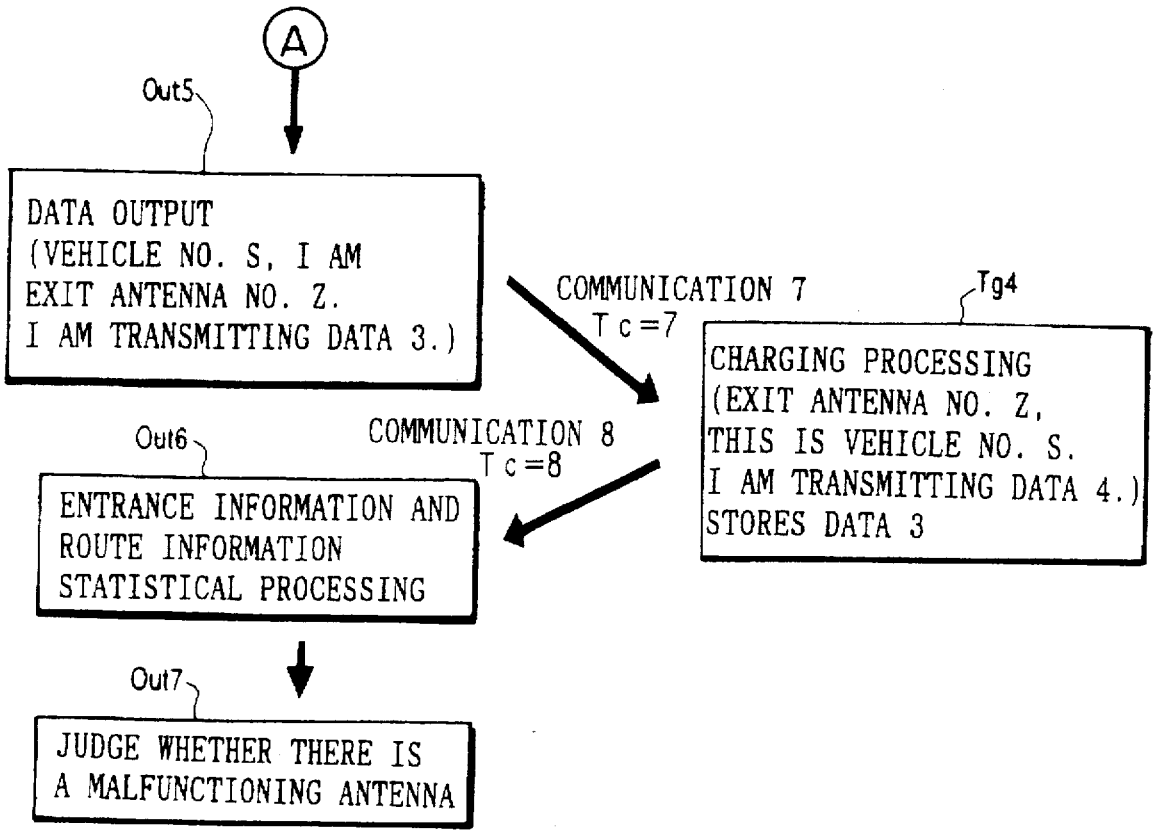
FIG. 8B is a process explanation diagram which summarily illustrates transmission and receipt (communication) of basic signals of a handshake which takes place between the vehicle device and the road device at the exit gate.

As illustrated in FIGS. 8A and 8B, an inquiry signal formed from a continuous wave is transmitted from the road device at the exit gate until the road device receives a response signal from a vehicle device (communication 1 transmitting process contents Out1).

When the vehicle device receives the inquiry signal, the vehicle device generates a response signal 1 which gives an authentication 1 serving as identification information. Thereafter, the vehicle device transmits the response signal 1 (communication 2 transmitting process contents Tg1).

When the road device receives the response signal 1 from the vehicle device, the road device generates a response signal which includes a response to the authentication 1 transmitted from the vehicle device and evidence of the road device carrying out the handshake, e.g., an authentication 2 formed by the antenna number. Thereafter, the road device transmits the response signal (communication 3 transmitting process contents Out2).

The vehicle device receives the response signal. When the authentication 1 included in the response signal matches, the vehicle device generates a response signal 2 to the authentication 2 transmitted from the road device, and transmits the response signal 2 (communication 4 transmitting process contents Tg2).

The road device receives the response signal from the vehicle device. When the authentication 2 included in the response signal matches, it is judged that the vehicle device and the road device recognize each other. At this time, the handshake is established, and the data 1 relating to the entrance gate is transmitted (communication 5 transmitting process contents Out3).

The data 1 transmitted by the road device at the exit gate includes gate information expressing that the gate is an exit gate, a gate number for identifying the exit gate, an antenna number for identifying the transmitting antenna, and the year, month, date, hour and minute.

The vehicle device receives the data 1 and stores it as exit information. Further, the vehicle device transmits data 2 relating to the vehicle device (communication 6 transmitting process contents Tg3).

The data 2 transmitted from the vehicle device at the exit gate includes an OK flag expressing that receipt of the data 1 this time has been completed properly, entrance information received at the entrance gate, route information received at route points, vehicle information such as the vehicle registration number or the vehicle type or the number of axles or the like, card information expressing the type of card such as a cash card or a pre-paid card or the like, and the card number or the balance information of the card.

The road device receives the data 2 and computes the toll (process contents Out4). Further, the road device collates the card number with a "blacklist" which has been readied in advance and which lists card numbers of cards which are being used without authorization or cards which cannot pay. When a card number included in the data 2 is on the blacklist, it may be difficult to collect payment for the toll. Accordingly, as a different process, an operation signal can be outputted for cooperation with the unauthorized passing vehicle photographing system 350 and the toll manual payment system 323.

When the process contents Out4 are completed and the card information verifies that the card can automatically pay the toll by radio communication, the road device transmits data 3 (communication 7 transmitting process contents Out5).

The data 3 transmitted by the exit gate road device includes an OK flag expressing that receipt of data 2 this time has been completed properly, the toll, and the results of collation with the blacklist (a flag expressing OK when the card number is not included on the blacklist).

The vehicle device receives the data 3, and if a pre-paid card is being used, the toll which was transmitted from the road device is withdrawn from the pre-paid card. Further, the vehicle device stores the data 3 as toll information, and transmits data 4 expressing that the toll has been withdrawn properly (communication 8 transmitting process contents Tg4).

When the road device receives data 4 from the vehicle device, as will be described later, the road device carries out statistical processing and malfunctioning antenna detection processing by using the entrance information and the route information obtained in the communication 6 (process contents Out6). Thereafter, the road device judges whether there is a malfunctioning antenna (process contents Out7). When it is judged that there is a malfunctioning antenna, the road device either prints out or transmits, to the gate at which the detected malfunctioning antenna is set, the antenna number for identifying the antenna.

When receipt of data 3 is completed, the handshake is dissolved. Further, after the process contents Out7, processing is implemented again from process contents Out1.

Next, the statistical processing at the gate 300 for malfunctioning antenna detection processing corresponding to the process contents Out7 will be described in detail with reference to the flowchart in FIGS. 9A and 9B.

In the malfunctioning antenna detection processing of the present embodiment, when the number of times vehicles have passed through a gate reaches a predetermined number (100 times in the present embodiment), at the exit gate 300, a communication probability for each antenna of that gate is determined, and malfunctioning antennas are detected by comparing this determined communication probability with a predetermined communication probability.

In the following explanation, gate number n is a given gate which may be the entrance gate, the exit gate, or any gate therebetween ($1 \leqq n \leqq N$, wherein N is the total number of gates), antenna number m is an antenna set at the gate number n ($1 \leqq m \leqq M_n$, wherein $M_n$ is the number of antennas at gate number n), counter value $C_n$ is a counter value at gate number n for computing the communication probability, and communication probability $P_{nm}$ is the communication probability for each antenna at gate number n (the communication probability of antenna number m at gate number n).

The following table showing the communication probabilities for the gate numbers and antenna numbers is stored in the local controller 380 and read.

| antenna | gate number | | | | | | |
|---|---|---|---|---|---|---|---|
| number | 1 | 2 | 3 | ... | n | ... | N |
| 1 | $P_{11}$ | $P_{21}$ | $P_{31}$ | ... | $P_{n1}$ | ... | $P_{N1}$ |
| 2 | $P_{12}$ | $P_{22}$ | $P_{32}$ | ... | $P_{n2}$ | ... | $P_{N2}$ |
| 3 | $P_{13}$ | $P_{23}$ | $P_{33}$ | ... | $P_{n3}$ | ... | $P_{N3}$ |
| . | . | . | . | . | . | . | . |
| . | . | . | . | . | . | . | . |
| . | . | . | . | . | . | . | . |
| m | $P_{1m}$ | $P_{2m}$ | $P_{3m}$ | ... | $P_{nm}$ | | $P_{Nm}$ |
| . | . | . | . | . | . | . | . |
| . | . | . | . | . | . | . | . |
| . | . | . | . | . | . | . | . |

Figure 9A:
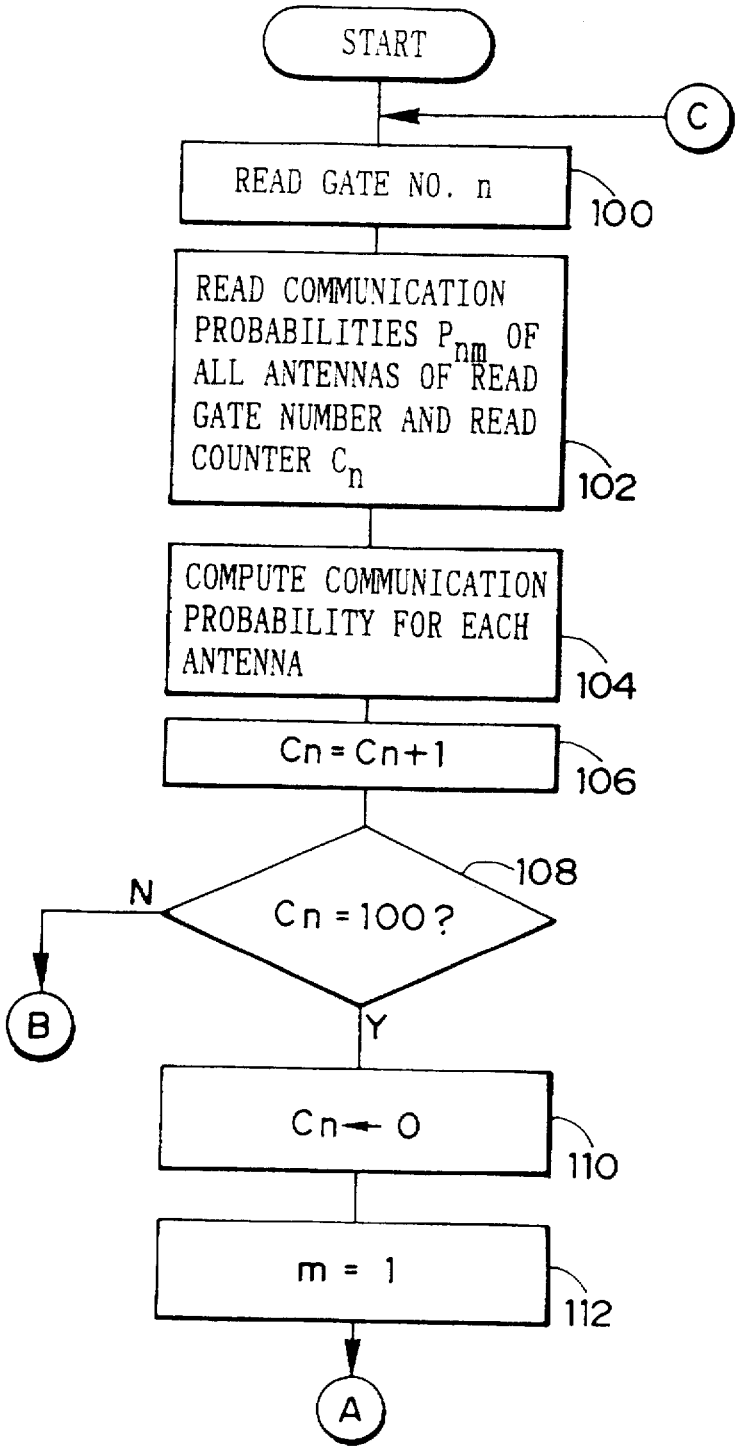
FIG. 9A is a flowchart illustrating the flow of a statistical processing routine for detecting a malfunctioning antenna at a road device.
Figure 9B:
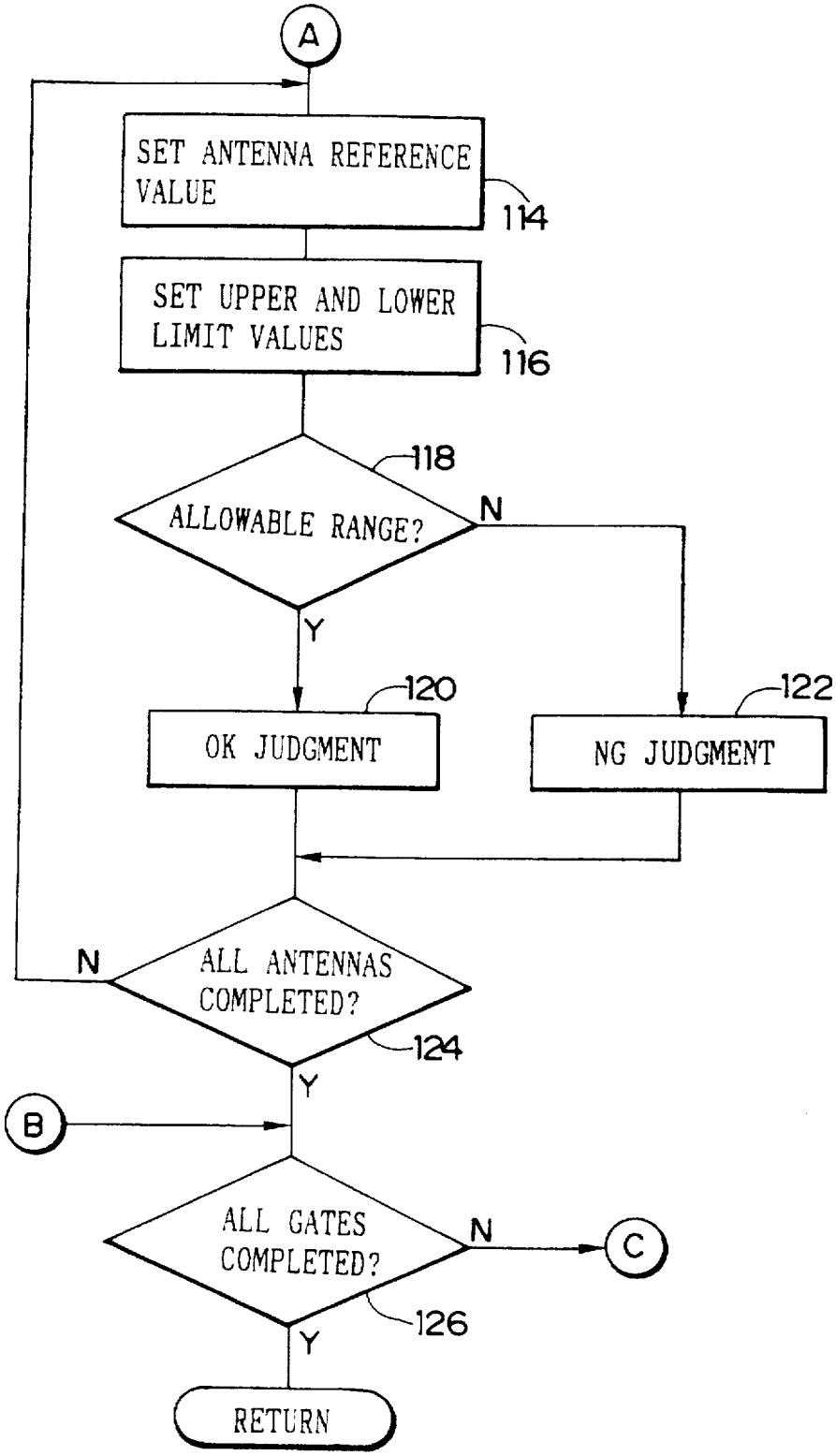
FIG. 9B is a flowchart illustrating the flow of a statistical processing routine for detecting a malfunctioning antenna at a road device.

The local controller 380 begins the statistical processing illustrated in FIGS. 9A and 9B when processing moves on to the process contents Out6 described above. First, in step 100 of FIG. 9A, one gate number n and antenna number m included in the entrance information and route information obtained in communication 6 are read. In subsequent step 102, the communication probabilities $P_{nm}$ of all of the antennas at the read gate number n are read from the table, and the counter value $C_n$ is read. Note that the initial value of the counter value $C_n$ is set to 0. In step 104, the communication probability of each of the antennas at the gate n is computed by using following formula (1).

$$\left.\begin{aligned} P_{nm} &= P_{nm} + \frac{1}{100} \\ P_{nk} &= P_{jk} - \frac{1}{100} \cdot \frac{1}{M_n - 1} \end{aligned}\right\} \quad (1)$$

(wherein k≠m)

The sum of the communication probabilities of all of the antennas at gate number n is 1 as is shown in following formula (2).

$$P_{n1}+P_{n2}+P_{n3}+\ldots+P_{nm}+\ldots P_{nMn}=1 \quad (2)$$

Accordingly, given that formula (2) is the probability computing formula which is established when vehicles have passed 100 times through gate number n, computation may be effected in step 104 such that, each time a vehicle passes through, as shown by formula (1), the communication probability of an antenna communicating with that vehicle increases by 1/100 and the communication probabilities of the other antennas respectively decrease by a value which is equal to 1/100 divided by the number of the other antennas. Formula (2) corresponds to the determination of an average value for each 100 times.

In subsequent step 106, the counter number $C_n$ is incremented. In step 108, by judging whether $C_n$=100, it is judged whether the number of times the communication probability has been computed from the entrance information or the route information from vehicles passing through gate number n has reached 100. If computation has not been performed 100 times, the process proceeds to step 126.

When $C_n$=100 and the answer to the determination in step 108 is affirmative, in step 110, the counter $C_n$ is reset ($C_n$=0) for the next computation for the gate n. In subsequent step 112, initial values are set for the antenna numbers m. (In the present embodiment, the antenna number of the first antenna is m=1.)

In step 114, a reference value $S_{nm}$ is set for the set antenna number m. The reference value $S_{nm}$ may be a predetermined, standard communication probability of the antenna number m when 100 vehicles pass through the gate n, or may be the communication probability of the antenna number m of the gate n determined by the previous processing for 100 vehicles which had passed through. If the communication probability determined the previous time is used as the reference value, malfunctioning antenna detection has already been carried out as will be described hereinafter, and therefore, repeat detection in the processing this time is suppressed.

In step 116, the lower and upper limit values $MIN_{nm}$, $MAX_{nm}$ of the antenna number m, which are set by using the reference value, are computed by using following formula (3).

$$\left.\begin{aligned} MIN_{nm} &= S_{nm} \cdot \left(1 - \frac{D}{100}\right) \\ MAX_{nm} &= S_{nm} \cdot \left(1 + \frac{D}{100}\right) \end{aligned}\right\} \quad (3)$$

wherein D: the allowable number of times for one antenna.

Figure 10A:
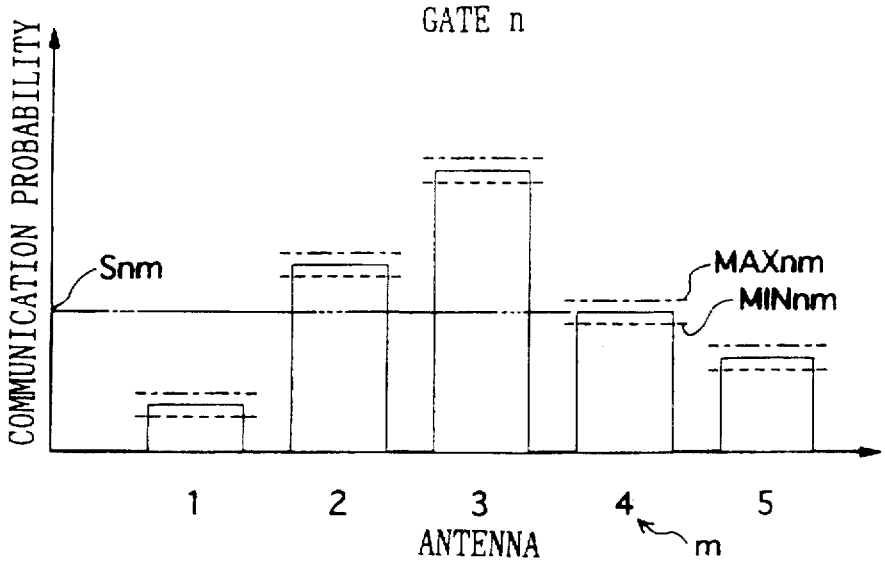
FIG. 10A is an explanatory diagram for explaining the relationship between an antenna and a communication probability.

FIG. 10A illustrates an example of the relationship between the antennas and the communication probabilities which are the standard at a gate n equipped with five antennas. As can be understood from the figure, the reference value $S_{nm}$ of the set antenna number m is set, and the lower and upper limit values $MIN_{nm}$, $MAX_{nm}$ of the antenna m are set.

Figure 10B:
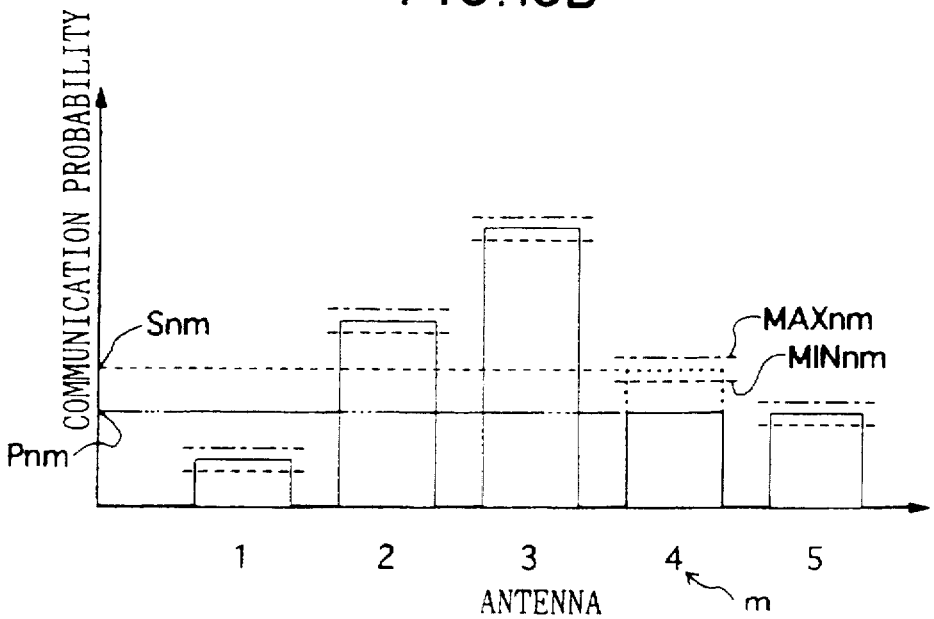
FIG. 10B is an explanatory diagram for explaining the relationship between an antenna and a communication probability.

In next step 118, by judging whether $MIN_{nm}<P_{nm}<MAX_{nm}$, it is judged whether the computed communication probability $P_{nm}$ falls within the allowable range. When $P_{nm}\geqq MAX_{nm}$ or when as in the case illustrated in FIG. 10B in which $MIN_{nm}\geqq P_{nm}$ such that $P_{nm}$ falls beneath the allowable range, the determination in step 118 is negative, and in step 122, an NG (no good) judgment is made. On the other hand, if the communication probability $P_{nm}$ falls within the allowable range, the determination in step 118 is affirmative, and an OK judgment is made in step 120.

In subsequent step 124, by judging whether the counter number is the largest antenna number of the gate n, it is judged whether the above-described processing has been completed for all of the antennas set at the gate n. When the judgment is negative, the process returns to step 114, and the above-described processing is repeated until processing has been completed for all of the antennas. On the other hand, if the judgment in step 124 is affirmative, the process proceeds to step 126.

In step 126, a judgment is made as to whether computation has been completed for all of the gates by judging whether other gate numbers n are included in the entrance information and the route information obtained in communication 6. In a case in which other gate numbers n are included in the entrance information and the route information, the judgment in step 126 is negative. The process returns to step 100, and the above-described processes are repeated. On the other hand, if there are no other gate numbers n, the judgment in step 126 is affirmative, and the routine ends.

In this way, for each antenna of each gate, a judgment is made as to whether the antenna is malfunctioning. Antennas of antenna numbers which were judged to be NG (no good) can be detected as malfunctioning antennas. The detected malfunctioning antennas are reported by the output device 390. This notification can be effected by informing an operator by printing by use of a printer, or by automatically informing the corresponding gate or a managing device of the gate by a modem device.

As described above, in the present embodiment, malfunctioning antennas of the road devices can be detected periodically by statistical processing from the information expressing the antennas of the road devices which information is stored in the vehicle device. Therefore, the conditions of the road devices can always be monitored. As a result, inspection and repair of a malfunctioning antenna can be carried out at an early stage, and satisfactory communication can be maintained.

The statistical processing for detecting a malfunctioning antenna can be realized by changing the algorithm of the road device. Therefore, no new algorithms are added to the vehicle device. Further, the above-described processing can be realized by merely adding the antenna number to the information used in the communication between the road device and the vehicle device. As a result, the structure of the device is not complex, and an inexpensive structure can be realized by using conventional devices. Moreover, because no deficiencies, defects, or the like in the information are caused by the addition of this algorithm, reliability does not deteriorate.

Because a malfunctioning antenna can be detected by the information received from the vehicle device, there is no need for tours of inspections or periodic inspections of each road device in order to detect malfunctioning antennas. Therefore, work efficiency and operational efficiency can be improved.

The above embodiment includes a description relating to antennas. However, the present invention can similarly be applied to antenna devices which include an antenna and an antenna control device which controls the antenna. Further, one type of malfunction is an inability to communicate. In a case in which an antenna is unable to communicate, for example, a lower limit value of the communication probability for each antenna may be set in advance, and an antenna having a value less than this lower limit value may be detected as a malfunctioning antenna.

Next, a second embodiment will be described. In the previously-described first embodiment, malfunctioning of antennas installed at an entrance gate and at route points is detected at the exit gate. However, in the second embodiment, at any gate after the entrance gate, malfunctioning antennas at gates therebefore can be detected. As the structure of the second embodiment is substantially similar to that of the first embodiment, the same structures are denoted by the same reference numerals, and description thereof is omitted. Further, in order to simplify the description, explanation will be given of a representative case in which the road device which communicates with the vehicle device 30 in the present embodiment is a road device which is provided at the exit gate 300 and is formed by the toll station antenna 342 and the toll station antenna control device 332A which are assigned to the transmission and reception of radio waves to and from vehicles traveling in the lane 302.

Figure 11:
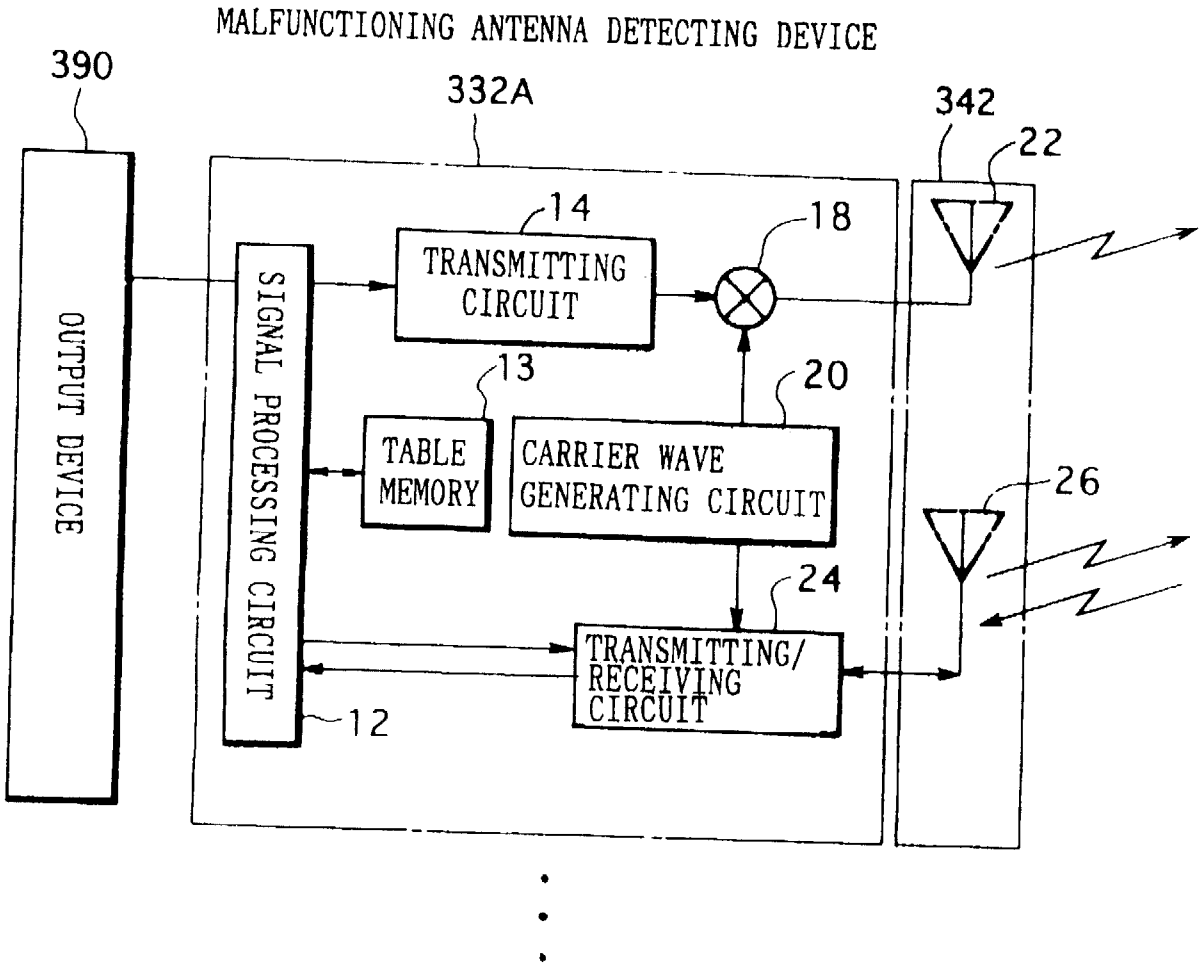
FIG. 11 is a block diagram illustrating a schematic structure of a vehicle device of a second embodiment.

As illustrated in FIG. 11, the toll station antenna control device 332A connected to the toll station antenna 342 is equipped with the signal processing circuit 12 which includes a microcomputer. A table memory 13, which is used to store the table described in the first embodiment, is connected to the signal processing circuit 12 of the present embodiment. Further, the output device 390 such as a printer device or a modem device for connection to a telephone line or the like is directly connected to the signal processing circuit 12 of the present embodiment. A program for implementing the malfunctioning antenna detection processing (FIGS. 9A and 9B) described in the first embodiment is stored in the signal processing circuit 12.

The structure of the other antennas at the exit gate is the same as the above-described structure, and therefore, description thereof is omitted. The structures of the respective antennas and antenna control devices at the route points 200 are also the same as the above-described structure, and therefore, description thereof will be omitted as well.

In the second embodiment, malfunctioning antenna detection processing can be carried out for each antenna control device. Therefore, the information relating to the antenna and stored in the vehicle device is not held in an unused state until the exit gate, and can be utilized at an antenna control device which is in charge of one antenna at a route point or the exit gate through which the vehicle passes. Accordingly, a malfunctioning antenna can be detected at an early stage at a closer gate. Inspection and repair of the malfunctioning antenna can be carried out at an early stage, and satisfactory communication can be maintained.

The processes Out6, Out7 at the exit gate and shown in FIG. 8B can be used at the process Ck4 at a route point and shown in FIG. 7 in order to detect, at a route point, a malfunctioning antenna.

In the above-described embodiments, the communication probabilities for all of the antennas at all of the gates are stored as a table. However, in accordance with this structure, the memory capacity becomes large, and consequently, the cost increases. Moreover, the computation time increases. In order to suppress such an increase in memory capacity, the number of gates held as a table may be decreased. For example, at a given gate having a gate number n, it suffices to store only information relating to antennas set at a predetermined number of gates, for example, the next closest gates having gate numbers (n−1) and (n+1). In this way, the memory capacity can be made smaller, and the computation time can be shortened. Further, because a detected malfunctioning antenna is at a gate near the gate which detected the malfunction, inspection and repair of the malfunctioning antenna can be effected at an early stage.

In the above-described embodiments, by setting a plurality of antennas to overlap over a single communication area, even if it is detected that one antenna is malfunctioning, communication is made possible by the other antennas assigned to that communication area. Therefore, even if inspection and repair of a malfunctioning antenna are being carried out, there is no need to close that communication area (system down), and it can still be used.

Figure 12:
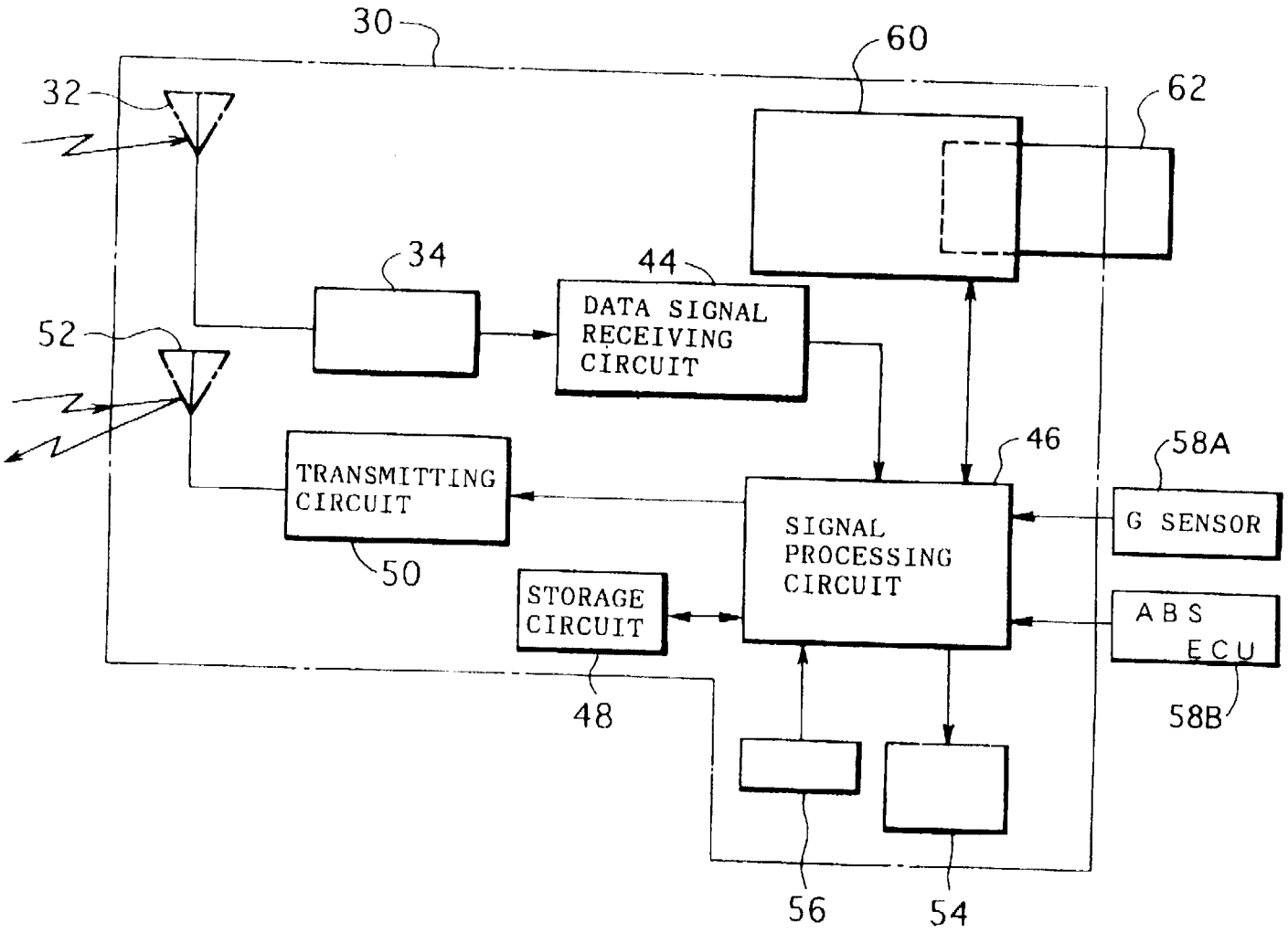
FIG. 12 is a block diagram illustrating an example of a structure of a vehicle device used in obtaining road information.

Further, in the above-described embodiments, action information, which expresses the actions of the vehicle, may be included as data transmitted from the vehicle device to the road device in order to learn that objects have fallen in the road or to ascertain the road conditions. The action information may include information expressing changes in steering, such as sudden operation of the steering wheel, or information relating to the road surface, such as slipping or the like. In this case, as illustrated in FIG. 12, the structure of the vehicle device 30 is such that a G sensor 58A, which detects drops in the road level and steering such as sudden operation of the steering wheel, and an ABS controller 58B, which detects the slip ratio, are connected to the signal processing circuit 46. In the vehicle device, the signal from the G sensor 58A and the signal from the ABS controller 58B are the action information and are stored together with positional information which is the gate number of the nearest gate passed through or the gate numbers of the gates at either side of the position. At the route points and the exit gate, the action information and the positional information are transmitted as data. From the action information and the positional information transmitted from the vehicle device, the road device detects sudden operation of the handle caused by avoiding a fallen object, variations in G caused by drops in the road level, variations in the slip ratio due to rain, snow or the like, and the road device determines the position from the positional information. In this way, the road device can ascertain the road conditions, and appropriate measures or notification can be made at an early stage.

Other action information may be obtained by detecting the rate of change of the suspension, by detecting the steering angle, the steering angle velocity and the steering angle acceleration, or by detecting the yaw rate by a yaw rate sensor.

What is claimed is:

1. A road/vehicle communication method for communication between a plurality of road devices, which are provided with a plurality of road antenna devices at respective gates, and a vehicle communication device, which is mounted to a vehicle and transmits and receives information to and from the plurality of road devices by radio waves, comprising the steps of:

(a) when the vehicle passes through a first gate, the vehicle communication device receiving gate information which includes at least one of a gate number and antenna number and which relates to the first gate and which is transmitted from a road antenna device of the first gate, and the vehicle communication device transmitting the received gate information at a second gate;

(b) the second gate receiving gate information from a plurality of vehicle communication devices, and computing a communication probability for each antenna device of the first gate when a number of received gate information corresponding to the first gate has reached a predetermined number; and (c) comparing, for each road antenna device, the communication probability with a predetermined reference value, and detecting as a malfunctioning road antenna device, a road antenna device for which a difference between the communication probability and the predetermined reference value exceeds a predetermined value.

2. A road/vehicle communication method according to claim 1, wherein the malfunctioning road antenna device is a road antenna device for which communication is impossible and for which the predetermined value is a lower limit value.

3. A road/vehicle communication method according to claim 1, wherein the road antenna device includes an antenna and an antenna control device which controls the antenna.

4. A road/vehicle communication method according to claim 1, further comprising the step of:

(d) when a malfunctioning road antenna is detected in said step (c), outputting information giving notice that a malfunctioning road antenna has been detected.

5. A road/vehicle communication method according to claim 1, wherein the gate information includes first information which specifies which road antenna device of the first gate transmitted the gate information.

6. A road/vehicle communication method according to claim 5, wherein the first information is an antenna number, and respectively different antenna numbers are given to each of the road antenna devices of the first gate.

7. A road/vehicle communication method according to claim 1, wherein the reference value is a communication probability set in advance for each of the road antenna devices of the first gate.

8. A road/vehicle communication method according to claim 7, wherein the communication probabilities set in advance are stored in table form.

9. A road/vehicle communication device for communication between a plurality of road devices, which are provided with a plurality of road antenna devices at respective gates, and a vehicle communication device, which is mounted to a vehicle and transmits and receives information to and from the plurality of road devices by radio waves, wherein the vehicle communication device includes:

storing means for storing gate information which includes at least one of a gate number and an antenna number and which is received when the vehicle passes through a first gate and which is transmitted from a road antenna device of the first gate and which relates to the first gate; and transmitting means for transmitting stored gate information at a second gate, and the road device includes:

roadside receiving means for receiving, at the second gate, gate information from a plurality of vehicle communication devices;

communication probability computing means for computing a communication probability for each road antenna device of the first gate when a number of received gate information corresponding to the first gate has reached a predetermined number comparing means for comparing, for each road antenna device, the communication probability with a predetermined reference value; and detecting means for detecting, as a malfunctioning road antenna device, a road antenna device for which a difference between the communication probability and the predetermined reference value exceeds a predetermined value.

10. A road/vehicle communication device according to claim 9, wherein the road device further includes:

outputting means for, when said detecting means detects a road antenna device as a malfunctioning road antenna device, outputting information including information expressing that the road antenna device has been detected as a malfunctioning road antenna device.

11. A road/vehicle communication device according to claim 9, wherein the road antenna device includes an antenna and an antenna control device which controls the antenna.

12. A road/vehicle communication device according to claim 9, wherein the gate information includes first information which specifies which road antenna device of the first gate transmitted the gate information.

13. A road/vehicle communication device according to claim 12, wherein the first information is an antenna number, and respectively different antenna numbers are given to each of the road antenna devices of the first gate.

14. A road/vehicle communication device according to claim 9, wherein the road device further includes:

second storing means for storing the reference value, and the reference value is a communication probability set in advance for each of the road antenna devices of the first gate.

15. A road/vehicle communication device according to claim 14, wherein the communication probabilities set in advance are stored in table form in said second storing means.

16. A road/vehicle communication device according to claim 9, wherein the malfunctioning road antenna device is a road antenna device for which communication is impossible and for which the predetermined value is a lower limit value.

17. A road/vehicle communication device according to claim 16, wherein the road antenna device includes an antenna and an antenna control device which controls the antenna.

* * * * *